US007603856B2

(12) United States Patent
Florean

(10) Patent No.: US 7,603,856 B2
(45) Date of Patent: Oct. 20, 2009

(54) HEAVY-CONSTRUCTION MACHINE

(75) Inventor: Gilles Florean, Archamps (FR)

(73) Assignee: Volvo Construction Equipment AB, Eskilstuna (SE)

( * ) Notice: Subject to any disclaimer, the term of this patent is extended or adjusted under 35 U.S.C. 154(b) by 558 days.

(21) Appl. No.: 11/424,771

(22) Filed: Jun. 16, 2006

(65) Prior Publication Data

US 2007/0180821 A1 Aug. 9, 2007

Related U.S. Application Data

(63) Continuation of application No. PCT/FR2004/050672, filed on Dec. 9, 2004.

(30) Foreign Application Priority Data

Dec. 16, 2003 (FR) ..... 03 51076

(51) Int. Cl.
*E02F 9/22* (2006.01)
*E02F 3/43* (2006.01)

(52) U.S. Cl. ..... 60/470; 60/494; 91/440; 91/464

(58) Field of Classification Search ..... 60/426, 60/427, 428, 429, 461, 469, 470, 472, 494; 91/440, 464, 465, 466
See application file for complete search history.

(56) References Cited

U.S. PATENT DOCUMENTS 5,513,491 A * 5/1996 Broenner et al. ..... 60/494

FOREIGN PATENT DOCUMENTS

DE 19548943 A1 12/1995
JP 60059236 4/1985

* cited by examiner

*Primary Examiner*—Thomas E Lazo
(74) *Attorney, Agent, or Firm*—Novak Druce + Quigg LLP

(57) ABSTRACT

A heavy-construction machine (1) including a working implement (5) having one or a number of arms (6) articulated with regard to the chassis (2) of the machine. An assembly consisting of at least one hydraulic cylinder (7) that causes the working implement (5) to move relative to the chassis (2) is provided together with a hydraulic circuit that supplies these cylinders based on the control commands issued by a hydraulic manipulator. The machine is capable of operating according to two distinct modes of which one is a lifting mode and the other is a loading mode. In each mode, cylinder travel can be freed when the manipulator is in a predetermined position corresponding to a position referred to as floating control. The machine further includes a mechanism for rendering the floating control position of the manipulator inactive when the machine is operating in lifting mode.

3 Claims, 3 Drawing Sheets

HEAVY-CONSTRUCTION MACHINE

CROSS-REFERENCE TO RELATED APPLICATIONS

The present application is a continuation patent application of International Application No. PCT/FR2004/050672 filed 9 Dec. 2004 which claims priority to French Patent Application No. 0351076 filed 16 Dec. 2003. Said applications are expressly incorporated herein by reference in their entirety.

TECHNICAL FIELD

The invention can be classified as belonging to the heavy construction machinery field especially machinery that is made for loading and for lifting.

The invention mainly targets the hydraulic circuit architecture of machines that allow optimal performance while in the loading mode of the machine for the purposes of leveling while maintaining a high-level of safety when it is in a lifting mode.

BACKGROUND

Generally, certain heavy construction machines are used to fulfill various functions by means of reconfiguring the work equipment. In fact, a traditional work machine, which has one or more arms, could have an attachment for a particular function fixed to its arm. Therefore, a bucket is generally used as a loader as it allows the loading of earth or other material to be transported and unloaded at another destination.

A loader is specifically used during leveling operations. In this case, the movement of the arm in relation to the chassis is left floating so that the bucket can move by scraping the ground and by evenly piling the mound of earth on which it rests. To free up the position of the bucket, usually the two piston chambers that control the direction are engaged. Thus, the machine works on what is known as a "floating" mode of command.

In practice, this "floating" command is obtained by reconfiguration of the hydraulic circuit achieved by the movement of manipulator controls in a particular position. Therefore, in a classic manner, the manipulator has a mobile inclined lever that will deliver variable pressure control based on this inclination. The "floating" position is normally found at the end of the manipulator stroke, which allows the generation of excess pressure in the control circuit. This excess pressure leads to the movement of the slide valves of the main distributor in such a way that the two piston chambers that are engaged become connected.

Furthermore, this same type of machine could also be used for lifting work. In that case, the tool that is attached to the working arm extremity is adapted for this kind of work and, for example, could be a pallet forklift or any other lifting mechanism. Then the hydraulic circuit of the piston chambers is generally equipped with valves known as "safety valves," used to insulate the piston chamber undergoing consecutive pressure from the weight of the load lifted.

In fact, in case there is a rupture in the piping of the hydraulic circuit it is important to be able to prevent this chamber from emptying too rapidly, which would cause the load to fall.

A safety problem could arise for machines which work in both loading and lifting modes. In fact, when it is in lifting mode, if an operator inadvertently moves the manipulator into the position known as the floating position while the two piston chambers are connected, the load will fall on the ground. This situation is unacceptable for obvious safety reasons.

For this reason, it was proposed that the floating control position for machines that work as both loaders and lifters should be eliminated.

At the same time, we think that this radical solution limits the performance of the machines mainly in leveling operations.

One of the objectives of the invention is to be able to combine the possibility of a floating position for use in loading with a high level of safety.

SUMMARY

The invention concerns a heavy construction machine, which acts in known ways as follows:

- work equipment including one or more articulated arms in relation to the machine's chassis;
- a unit of at least one hydraulic jack for the movement of the work equipment in relation to the chassis; and
- a hydraulic circuit feeding these jacks based on the control commands given by a hydraulic manipulator.

This machine is multi-functional, that is, it is able to work in two different modes. Therfore, it can ensure lifting as well as loading functions. In the latter case, the stroke of the jack causing the movement of the machine in relation to the chassis could be made free when the manipulator is placed in a particular position corresponding to the "floating" command.

According to the invention, the machine is characterized by the fact that it has the means to make the floating command of the manipulator inactive when the machine is in the lifting mode.

In other words, the invention prevents the command to move to the "floating" position while the engine works in the lifting mode.

Thus, the invention can prevent the machine from inadvertently going into a floating position, which, in turn, would have caused the load to fall. The safety of the machine is, therefore, ensured in the lifting mode and performance remains high as the leveling operations are still allowed with a floating bucket.

In a particular mode of operation, the movement of the manipulator into the floating command position generates excess pressure in the control portion of the hydraulic circuit. In this case, while the machine is working in lift mode, a pressure reducer inserted into the circuit is activated to limit or even eliminate the effect of this excess pressure. Therefore, even if the operator places the manipulator in the floating position, the corresponding excess pressure is not taken into account by the hydraulic power circuit.

In practice, a diverter valve could be placed parallel to the pressure reducer in order to by-pass the reducer when it should not be working. Thus, when the machine is working in loading mode, the pressure reducer is by-passed so that the excess pressure generated by the manipulator in the floating command is effectively transmitted to the rest of the hydraulic circuit. However, when the machine is working in lifting mode, the regulating valve is blocked in such a way that the pressure reducer does its job and thus blocks the excess pressure generated by the manipulator in case the operator inadvertently places the manipulator in the floating command position.

Advantageous in practice, the configuration of the hydraulic circuit in lifting mode or loading mode can be done by a manual selector, which commands the diverter valve located parallel to the reducer.

BRIEF DESCRIPTION OF THE DRAWINGS

The manner in which the invention is made and the advantages resulting from it will be clear from the production description which is given below, with the help of an example and figures attached hereto as follows.

DETAILED DESCRIPTION

Figure 1:
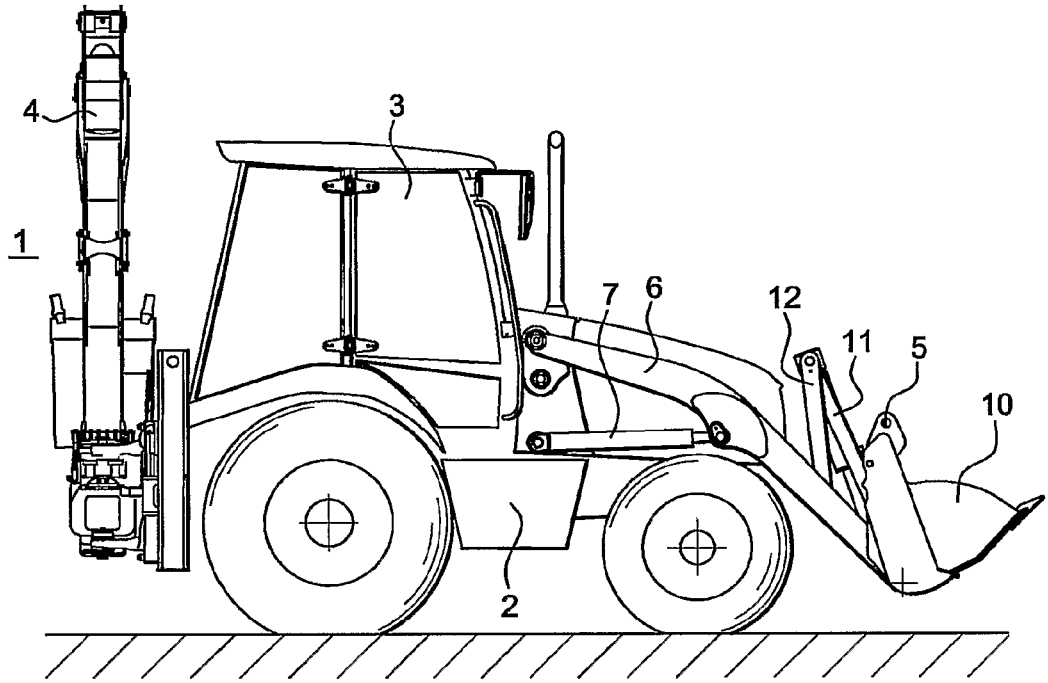
FIG. 1 is a profile view of a heavy construction machine working in the loading mode.

As mentioned earlier, the invention pertains to a heavy construction machine able to work in two different modes. The machine (1), shown in the diagram in FIG. 1 classically consists of a chassis (2) with a cab (3). At the rear, the machine has work equipment (4) allowing it to work as an excavator, and in the front it has articulated work equipment or implement (5) allowing it to carry out the work of a loader. More specifically, this work equipment (5) has an articulated arm (6) in relation to the chassis that is mobile because of a lifting jack (7). At the extremity of the arm (6) there is an articulated bucket (10) which is mobile with relation to the arm (6) through the bucket jack (11), associated by a parallelogram system (12). Because of the bucket jack (11) it is possible to incline the bucket.

Figure 2:
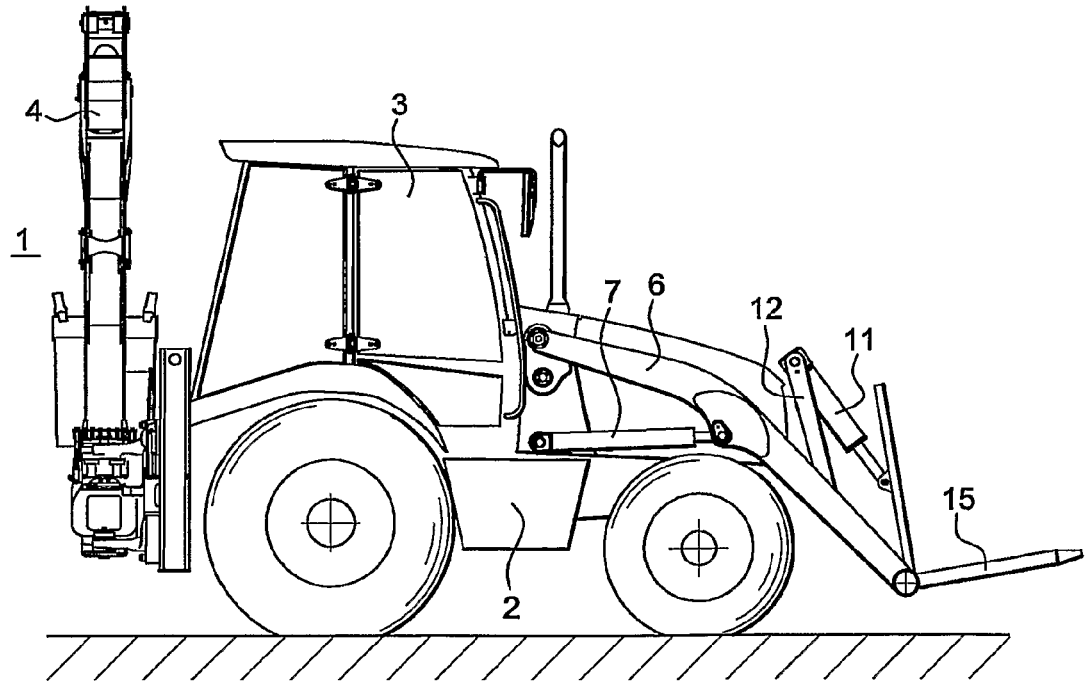
FIG. 2 is a profile view of the same machine, working in a lifting mode.

In practice, the bucket (5) could be replaced by a pallet forklift (15) as illustrated in FIG. 2 or by other accessories that would help it with the lifting functions.

Figure 3:
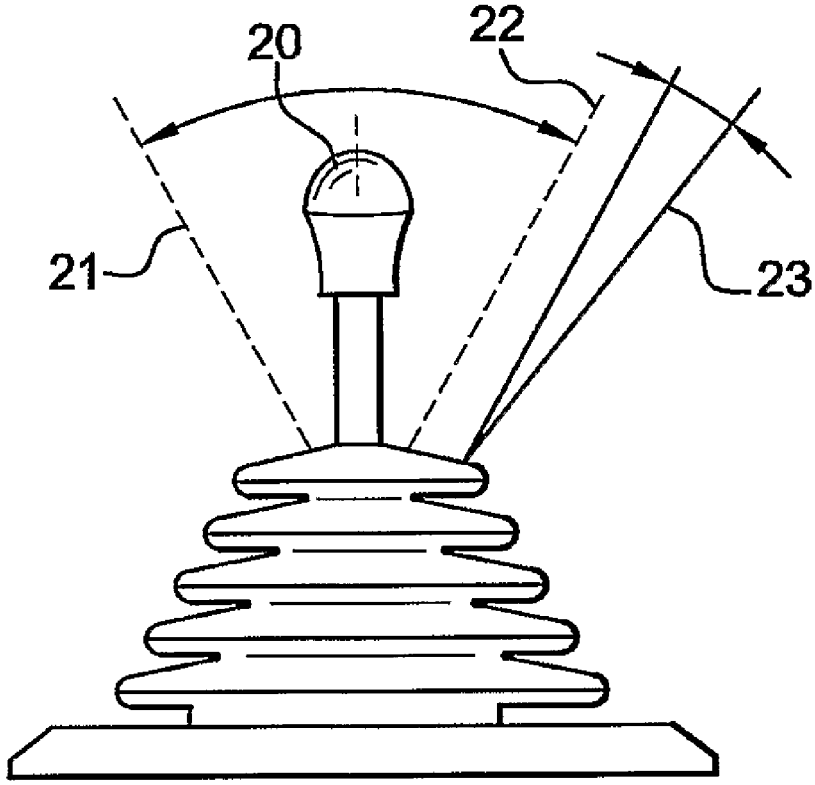
FIG. 3 is a profile view of the visible part of the command manipulator.

Classically, the machine can work in loading mode by using a special function called the "floating command". In this case, the lifting jack (7) does not exert force on the arm (6) and the position of the arm is thus free in relation to its articulation and the chassis (2). This position, known as the "floating" position, is obtained by putting the hydraulic manipulator in a specific position. Specifically, and as illustrated in FIG. 3, a hydraulic manipulator (20) has a lever, which can be inclined forward and backward to get the arm to incline either upwards or downwards.

Figure 4:
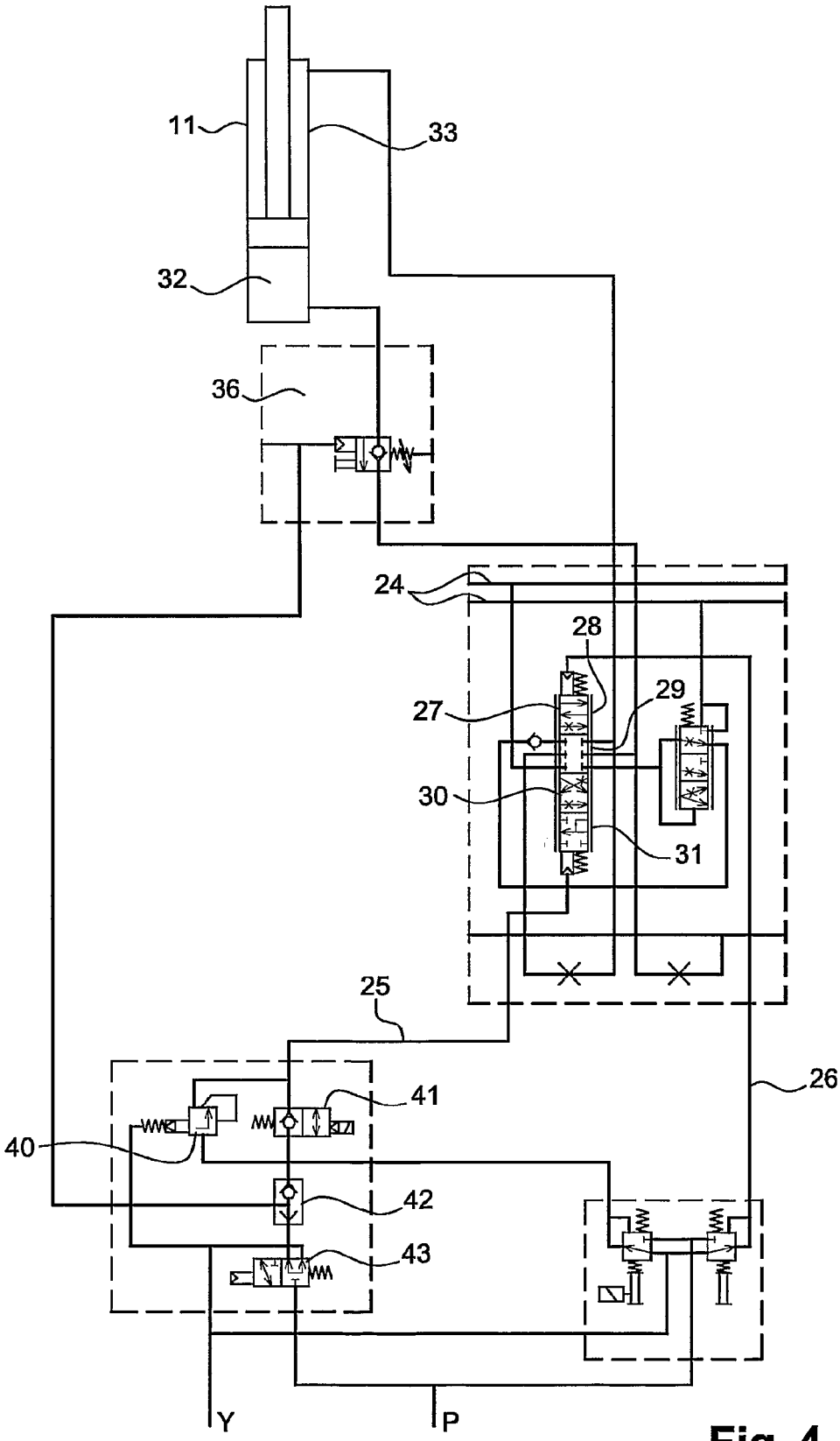
FIG. 4 is a diagram illustrating the hydraulic circuit of such a machine.

This variation in the inclination is obtained when the lever (20) inclines between two limited positions (21, 22). In this case, the inclination of the manipulator allows, as illustrated in FIG. 4, command pressure to be exerted typically between 1 and 23 bars. This pressure is brought by the piping (25, 26) to the distributor (27) which moves in such a way that its first three slides valves (28, 29, 30) connect the main source of pressure (24) with the chambers (32, 33) of the jack (11).

Beyond the position that is generally the front limit position (22), the manipulator moves into the position known as the "floating command" when its inclination reaches a farther position (23).

In this case, additional pressure, typically around 27 bars is delivered to the distributor (27). In that case, the fourth slide valve (31) connects the two chambers (32, 33) of the lifting jack (7), which makes the arm float.

It is noted in FIG. 4 that the hydraulic circuit carries a safety valve (36) on the part that feeds the chamber (33). This valve controlled electrically, or as shown in the figure, hydraulically, allows the insulation of chamber (33) of the jack (7) in case the flexible connection located in front ruptures. This would prevent the chamber (33) from emptying out, which would lead to dropping of the load.

In accordance with the invention the excess pressure generated by the over stroke of the manipulator (20) to bring the bucket to a floating position is eliminated when the machine works in the lifting mode. Thus, when the operator places his machine in lifting mode using an appropriate selector available in the cab, the hydraulic circuit is consequently reconfigured. More specifically, as shown in FIG. 4, a pressure reducer (40) is inserted between the manipulator (20) and the distributor (7). This reducer (40) delivers maximum pressure, limited to around 23 bars, corresponding with the pressure delivered by the manipulator within the normal stroke limits (22). This maximum pressure value of 23 bars is delivered, even when the manipulator is placed involuntarily in the over stroke area corresponding to the floating position of the bucket. This maximum value can be adjusted which allows the user to set the maximum speed on the arm's descent.

On the other hand, in the loading mode a by-pass valve (41) is activated in such a way that it shunts the reducer (40) and therefore allows the eventual excess pressure delivered by the manipulator in a floating position to act appropriately on the distributor (31). This by-pass valve (41) is rendered inactive when the selector indicates a lifting mode function.

A non-return valve (42) can be placed in combination with an electrovalve (43) to allow the blocking of the safety valve during the movement of the manipulator (20) in the direction of the arm's descent or when the machine is fitted with hydraulic suspension of work equipment.

Based on the above, it is clear that the machine made according to the invention allows work with a floating bucket in a loading mode while at the same time ensuring maximum safety in the lifting mode, since in the latter case, the floating position is neutralized.

What is claimed is:

1. A heavy construction machine comprising:

a work implement including one or several arms, articulated in relation to a chassis of the machine;

a unit with at least one hydraulic jack for moving the work implement in relation to the chassis; and a hydraulic circuit feeding the jacks as per commands sent by a hydraulic manipulator and wherein the machine is capable of working in two different modes, a lifting mode and a loading mode in which the course of the jack can be made free when the manipulator is in a predetermined position corresponding to a position known as the "floating command", and with hydraulic components configured to make the position known as the floating command of the manipulator inactive when the machine is in a lifting mode, configured such that when the manipulator is in the position known as the floating command, it generates excess pressure in the hydraulic circuit command portion and, when the machine is working in a lifting mode, a pressure reducer is activated in order to limit the effect of the excess pressure.

2. The heavy construction machine as recited in claim 1, further comprising a diverter valve disposed parallel to the pressure reducer.

3. The heavy construction machine as recited in claim 2, wherein the lifting and loading mode is configured via the hydraulic circuit and is effected by a manual selector that controls the diverter valve.

* * * * *